United States Patent [19]

McWhorter

[11] Patent Number: 4,463,710

[45] Date of Patent: Aug. 7, 1984

[54] ENGINE CONNECTING ROD AND PISTON ASSEMBLY

[76] Inventor: Edward M. McWhorter, 6931 Greenbrook Cir., Citrus Heights, Calif. 95610

[21] Appl. No.: 328,364

[22] Filed: Dec. 7, 1981

[51] Int. Cl.[3] ..... F02B 75/32

[52] U.S. Cl. ..... 123/48 B; 123/78 B; 123/197 AB

[58] Field of Search ..... 123/48 R, 48 B, 78 R, 123/78 B, 78 A, 78 E, 197 R, 197 A, 197 AB

[56] References Cited

U.S. PATENT DOCUMENTS

| | | | |
|---|---|---|---|
| 2,194,022 | 3/1940 | Kitzeman | 123/78 B |
| 3,859,976 | 1/1975 | McWhorter | 123/197 AB |
| 3,908,623 | 9/1975 | McWhorter | 123/197 AB |

*Primary Examiner*—Craig R. Feinberg

[57] ABSTRACT

The invention is a new and useful improvement in the design of connecting rods and pistons for use in reciprocating piston driven internal and external combustion engines and in reciprocating compressors. In the design presented the connecting rod is pivotally attached by a pin to a slider which is slidably mounted in the internal volume of the piston crown. Gas pressure forces generated in the engine cylinder above the piston crown are transmitted to a second pin which is pivotally mounted in a carrier which is in turn slidably mounted in an inclined slot in the connecting rod. Changes in angularity of the connecting rod, caused by rotation of the engine crankshaft, result in the piston being alternately raised and lowered as the carrier holding the second pin slides alternately to the right side and to the left side of the inclined slot thus augmenting the reciprocating motion of the piston. The purpose of the invention is to control the initial and terminal piston speed when the crankshaft is near the top-dead-center or near the bottom-dead-center position of rotation respectively.

3 Claims, 11 Drawing Figures

ENGINE CONNECTING ROD AND PISTON ASSEMBLY

BACKGROUND OF THE INVENTION

1. Field of the Invention

The invention is a connecting rod and piston assembly for use in internal and external combustion engines and in reciprocating compressors. It comprises the reciprocating linkage rotatively connected to the crankpin of a crankshaft which may have a plurality of such crankpins and connecting linkage. In the design presented the piston speed on the initial downstroke varies from the terminal speed on the upstroke as measured at corresponding angular stations symmetrical on each side of the top-dead-center position of crank rotation. For this reason the invention may also be classified as a variable-stroke engine.

2. Description of Prior Art

The reciprocating components of most piston driven engines are mechanically described as four-bar linkages with a sliding member and essentially comprising the elements of a crank, a connecting rod and a piston. There are however, other types of reciprocating linkages which are more complex. One example is an engine which employs a crosshead mechanism which is mounted below the piston and moves simultaneously in a transalatory path parallel with the piston. The purpose of the crosshead in previous designs has in general been to facilitate the sealing of the crankside of the cylinder in compound engine systems.

The present invention also employs a crosshead mechanism, but in this application its purpose and general operation are much different than the earlier use described. In the design presented the crosshead, hereinafter termed the "piston-slide", is slidably mounted in the piston crown. Its purpose is to provide a pivot-point for the connecting-rod in a manner which is independent of the piston wrist pin, hereinafter termed the "piston-pin", and to also compensate for cyclic changes in the connecting rod effective length as measured from the axial center of the piston-pin to the axial center of the crankpin.

Previous investigators, Mallory, U.S. Pat. No. 1,379,115 and McWhorter U.S. Pat. Nos. 3,859,976 and 3,908,623 also used piston slides for this purpose in the design of variable stroke engines. In these designs the piston slides were slidably mounted in the piston skirt or in the piston crown in a manner similar to the present invention and were also used to compensate for cyclic changes in the effective length of the connecting rod resulting from the class 1 and class 2 lever action linkage which was pivotally attached to the piston pin.

In the present invention the piston pin is pivotally mounted in a carrier which slides laterally to the right or to the left within an inclined slot provided at the upper end of the connecting rod. The pivotal action of the connecting rod at the piston end, resulting from changes in angularity with rotation of the crank, is performed by a second pin, hereinafter termed the "pivot pin". The pivot pin is pivotally mounted in the piston slide which is in turn slidably mounted in a machined surface within the piston crown. The primary difference between the present invention and those previously referenced is the use of a carrier working within an inclined slot which is used as a means of raising and lowering the piston pin instead of pivotal linkage. This type of design reduces the weight of the reciprocating mass by eleminating the use of heavier pivotal linkage and therefore reduces the dynamic loads, particularly at high engine speed.

The sliding movement of the carrier within the inclined slot of the connecting rod causes the distance between the axial centers of the piston pin and crankpin to vary in a manner which is proportional to the degree of inclination of the slot relative to the angular position of the connecting rod. Because the piston follows the motion of the piston pin an additional degree of control of piston motion is therefore achieved by the invention. Although the amount of augmenting piston motion achieved by the additional linkage is slight, it is very advantageous—particularly when the piston is near the top-dead-center position of the crank rotation where the clearance volume above the piston crown is small. At this position, very slight changes in piston motion will most significantly effect temperature and pressure within the small volume of the clearance and can therefore be used to beneficially influence the conditions of ignition and the post-ignition conditions of the combustion reaction.

The invention can be used to slow the piston speed during the initial downstroke of the combustion period. Combustion is therefore achieved at conditions which more closely simulate the efficiency of the theoretical constant volume process. Operation in this manner increases the mean effective operating pressure of the engine and thereby increases the overall thermal efficiency of the working process.

The invention can also be used to slow piston motion at the bottom-dead-center position of crank rotation. This provides additional piston dwell during the initial exhaust blowdown and during the terminal induction period thereby decreasing the amount of pumping work required during the exhaust cycle and increasing the volumetric efficiency of the induction cycle. The additional piston dwell at bottom-dead-center increases the efficiency of the mass transfer processes of the 2-stroke engine cycle and is also effective in increasing the volumetric efficiency of reciprocating compressors.

SUMMARY

The invention is a reciprocating mechanism comprising a connecting rod and piston assembly. Its primary mechanical function is to modify and augment the kinematic relationship of the translatory and rotary elements of reciprocating piston driven engines and compressors in a manner which is beneficial to the performance and efficiency of their operation. It is therefore the primary object of the invention to provide a reciprocating mechanism which is capable of augmenting piston motion near the top-dead-center position of crank rotation.

Another object of the invention is to provide a means of slowing piston speed when the crank is near the bottom-dead-center position of its rotation thereby increasing the induction period which lessens the effect of the inherent flow restriction at the inlet. This feature is also beneficial in the operation of compressors during the charging stroke.

It is yet another object of the invention to provide a means of complementing the control of temperature and pressure conditions in the clearance of internal combustion engines during ignition and the subsequent initial combustion period.

And still another object of the invention is to decrease the pumping losses during the exhaust cycle by slowing the piston speed during the initial blowdown allowing a greater mass of combustion gas to escape before the piston pumping action begins.

It is another objective of the invention to reduce the weight of the reciprocating components of engines of the general character described in order to decrease dynamic loads.

All of these and still further objectives and advantages of the invention will become apparent from the study of the specification which follows.

BRIEF DESCRIPTION OF THE DRAWINGS

Drawings showing the novel features of the design are provided as part of the specification.

DESCRIPTION OF THE PREFERRED EMBODIMENT

Figure 1:
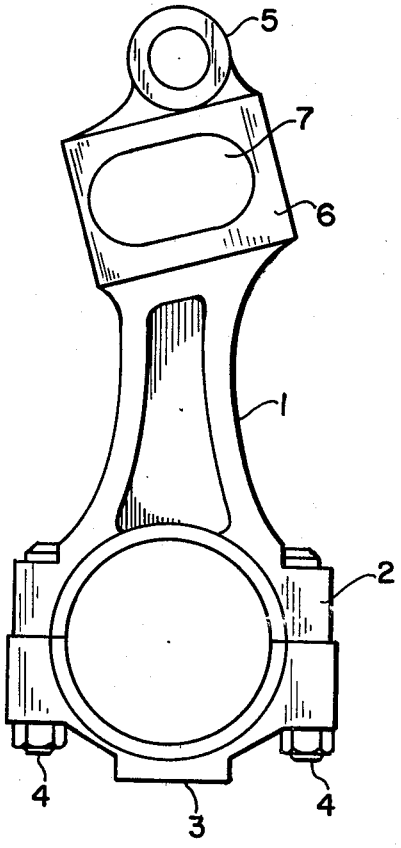
FIG. 1 is a frontal view of the connecting rod.

Referring now to the drawings and to FIG. 1 thereof in particular showing the frontal view of connecting rod 1. The elements comprising the connecting column of connecting rod 1 are large journal 2, journal cap 3, which is bolted to the large journal 2 by bolts 4, pivot journal 5, piston pin slots 7, located on each side of carrier housing 6. Carrier housing 6 is positioned on connecting rod 1 at an inclined angle relative to the longitudinal axis which passes through the center of the connecting column and the axial centers of large journal 2 and pivot journal 5. The degree of inclination is a matter of design preference which is based principally on the type and size of the engine.

Figure 2:
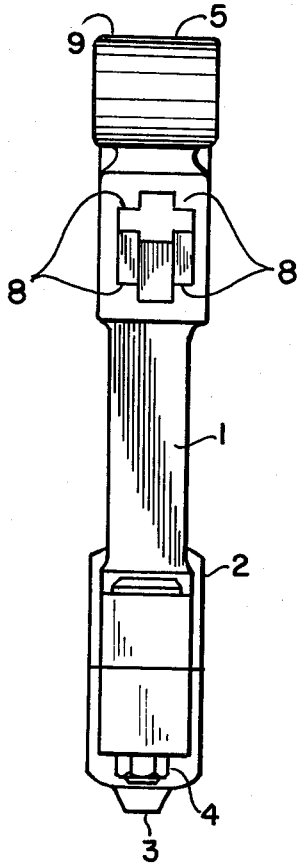
FIG. 2 is a side view of the connecting rod.

Turning now to FIG. 2 which is a side view of connecting rod 1 presenting the interior details of the inclined carrier housing 6 showing carrier slide surfaces 8 which are located at the top and bottom of the housing and are likewise inclined. Other details of connecting rod 1 shown in this view are presented for comparative purposes. A section of the inclined carrier housing 6 cut at point 9 is presented as a cutaway frontal view in FIG. 3.

Figure 3:
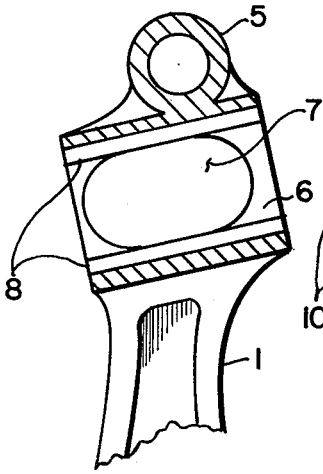
FIG. 3 is a cutaway view of the upper portion of the connecting rod showing the inclined slot housing in cross-section.

FIG. 3 shows the relative position of the carrier slide surfaces 8 and the piston pin slots 7 located on each side of the inclined carrier housing 6. The carrier slide surfaces 8 are shown as planar surfaces positioned at each corner of inclined carrier housing 6. The degree of inclination of carrier slide surfaces 8, as in the case of carrier housing 6, is a matter of design and will vary with the conditions of each particular application. In order to generate a slightly different piston motion these carrier sliding surfaces can be constructed as parallel curved surfaces shown as alternate design carrier slide surfaces 10 in FIG. 4. The carrier slide surfaces can also be constructed as concave downward as shown by alternate carrier slide surfaces 11 in FIG. 5. Although four carrier slide surfaces are shown in FIG. 2 and indicated in FIGS. 3 to 5 the intended operation of the mechanism can be performed with only a single upper and lower carrier slide surface or with a plurality of such surfaces located at the top and bottom of inclined carrier housing 6.

Figure 6:
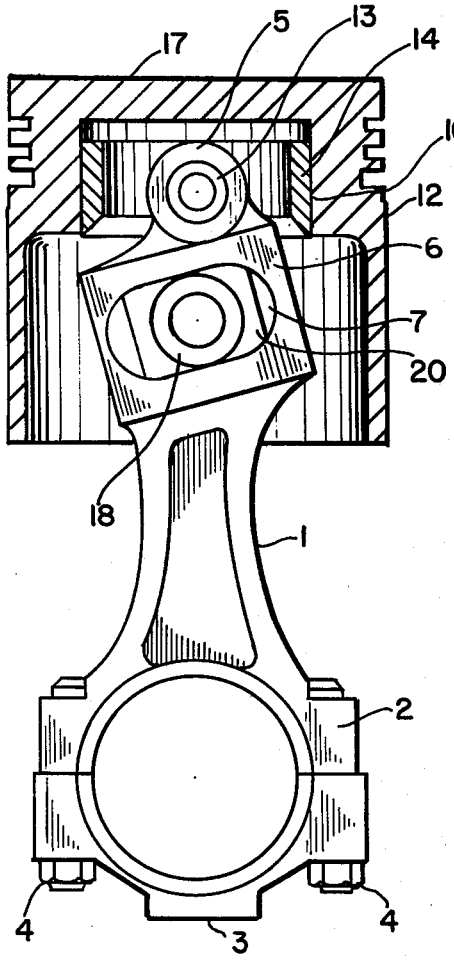
FIG. 6 is a frontal view of the connecting rod and piston assembly with the piston shown in cross section.
Figure 7:
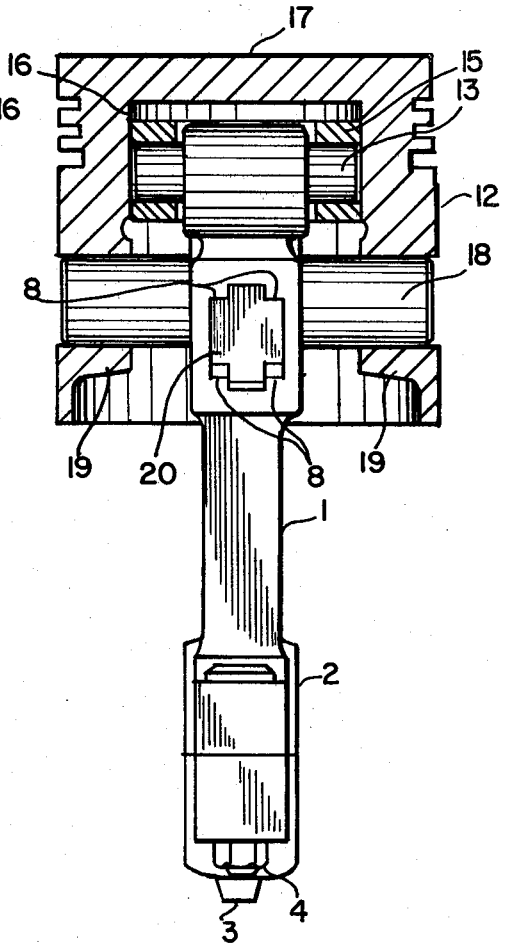
FIG. 7 is a side view of the connecting rod and piston assembly with the piston sectioned at the piston pin bosses.

Referring now to FIG. 6 which shows connecting rod 1 pivotally attached to piston 12 by pivot pin 13 which passes through pivot journal 5 and extends transversly on each side. Each end of pivot pin 13 is pivotally journalled in piston slide 14 bosses 15, which are not shown in this view but are shown in FIG. 7. Piston slide 14 is depicted as a cylindrical section having two thickened areas forming bosses 15. Piston slide 14 is slidably mounted in machined surfaces 16 of piston crown 17. Piston slide 14 does not receive the direct compressive or tensile loads of piston 12. The load forces operating on piston slide 14 are principally lateral thrust loads resulting from the cyclic pivotal action of connecting rod 1 as it changes angularity. Although piston slide 14 is depicted as a cylindrical section it may be square or any other suitable shape which can structurally accommodate the imposed loading. In a similar manner the matching machined surfaces 16 may be constructed as press-fit or steel insert surfaces placed in the mold prior to casting, without effecting the intent or operation of the mechanism.

Compressive and tensile loads resulting from gas pressures above piston crown 17 and dynamic forces inherent in the design are transferred to piston pin 18 which passes through piston pin slots 7 and extends transversly across piston 12 and is pivotally journalled at each end in piston bosses 19 positioned on opposite adjacent sides of piston 12 skirt which are not shown in this view but are shown in FIG. 7. Piston pin 18 is journalled in a piston pin hole in carrier 20 which is in turn slidably mounted on carrier slide surfaces 8.

Referring now to FIG. 7 which is a side view of the reciprocating assembly which more clearly shows the method of pivotally mounting pivot pin 13 in piston slide 14 bosses 15 and piston pin 18 in piston bosses 19 attached to the skirt of piston 12. Carrier 20 is shown slidably mounted on carrier slide surfaces 8. Other details of the reciprocating parts shown in FIG. 7 are presented for clarification and comparative purposes.

Figure 8:
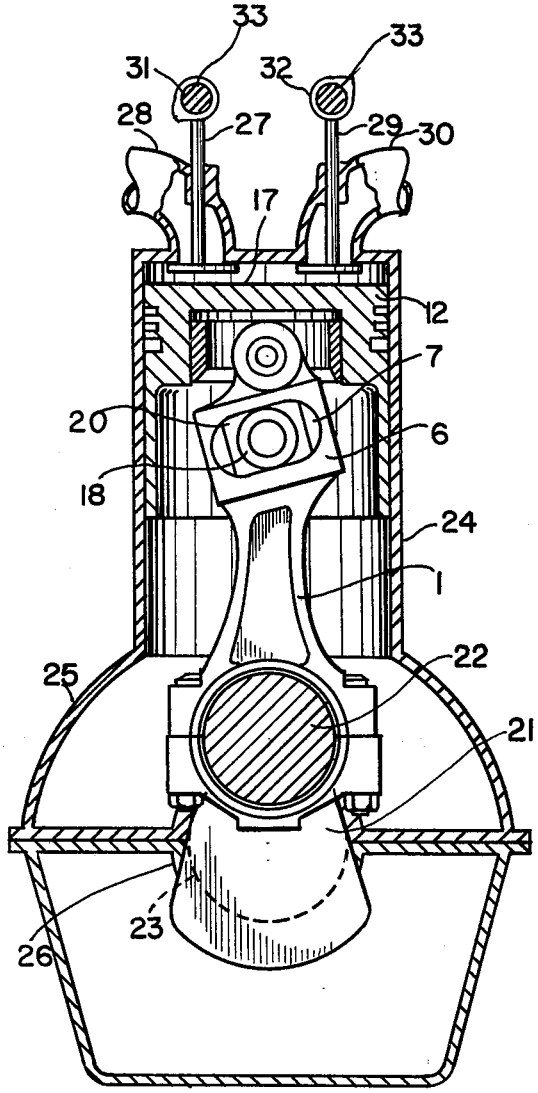
FIG. 8 is a frontal view of the reciprocating assembly at the top-dead-center position of crank rotation as mounted in a diagrammatic illustration of the surrounding engine shown principally in cross section.

Looking now at the method of operation and in particular the synergistic relationship of the various components within the complete engine system. FIG. 8 shows the relative position of the elements comprising the reciprocating assembly mounted in the engine when the piston 12 is at the top-dead-center position. Connecting rod 1 is rotatively mounted on crankpin 22 which is connected to crankshaft 23, shown in phantom line, by crank arm 21. Piston 12 is shown slidably mounted in engine cylinder 24 which is fixedly attached to crankcase 25. Crankshaft 23 is rotatively mounted in crankcase journal 26. Induction valve 27, which is of the usual poppet type of construction, controls the flow of the fuel and air charge, or in the case of diesel engine operation only air, in the induction conduit 28. Exhaust valve 29, also shown as a poppet valve, controls the flow of combustion gases exiting the engine through exhaust conduit 30. Induction valve 27 and exhaust valve 29 are operated in the usual manner by induction cam 31 and exhaust cam 32 respectively. Induction cam 31 and exhaust cam 32 are fixedly mounted on camshaft 33 which is mechanically connected to crankshaft 23 in the usual manner either by means of sprocket and chain or by gears which are not shown. Rotation of crankshaft 23 induces a corresponding rotation of camshaft 33 which opens and closes induction valve 27 and exhaust valve 29 in a sequential manner characteristic of the particular engine process and method of operation. The direction of inclination of inclined carrier housing 6 and carrier slide surfaces 8 may differ with other types of engines and other kinds of process operation.

Figure 9:
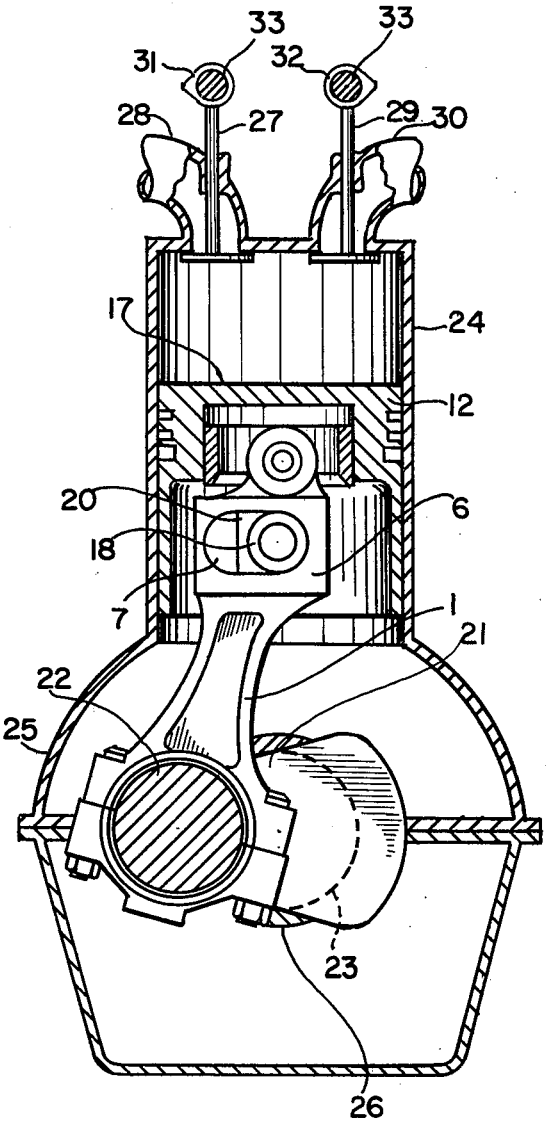
FIG. 9 is a frontal view of the reciprocating assembly showing the positional relationship of the various components within the engine when the crank is at the 90° position of rotation.

As crankshaft 23 is rotated 90° in a counter clockwise direction during the power stroke, piston pin 18 is carried by carrier 20 to the right side of piston pin slot 7 as carrier 20 slides on carrier slide surfaces 8. This positional relationship is shown in FIG. 9. At this position the distance between the axial centers of piston pin 18 and crankpin 22 is greater than when the crankshaft 23 was at the top-dead-center position as previously shown in FIG. 8. The increased distance between axial centers of piston pin 18 and crankpin 22 is the result of the levering action of connecting rod 1 which causes carrier 20 to be moved upward on the incline of carrier slide surfaces 8. Sliding friction of the carrier is overcome by the mechanical advantage of the class-two lever action of connecting rod 1 which has its fulcrum centered on the axis of the pivot pin. Frictional losses are attenuated by the gradual decrease in inclination of carrier slide surfaces 8 with the changing angularity of connecting rod 1 as crankarm 21 approaches the 90° position of rotation.

The effective length of connecting rod 1 is continuously variable and changes in a manner corresponding to the rotational position of crankshaft 23 and to the degree of inclination of carrier slide surfaces 8. The increased effective length of connecting rod 1 during the first 90° of crankrotation results in a slightly slower initial piston speed when compared to standard 4-bar linkage of the conventional engine. Therefore, volumetric changes in engine cylinder 24 are also slower causing a correspondingly attendant increase in combustion gas pressures above piston crown 17. The increased residence time at the higher combustion pressures and corresponding temperatures enhance the possibility of using slower burning fuels in some applications. The higher combustion pressures also increase the net rotative effort applied to the crank and thus increases the engine power output.

Figure 10:
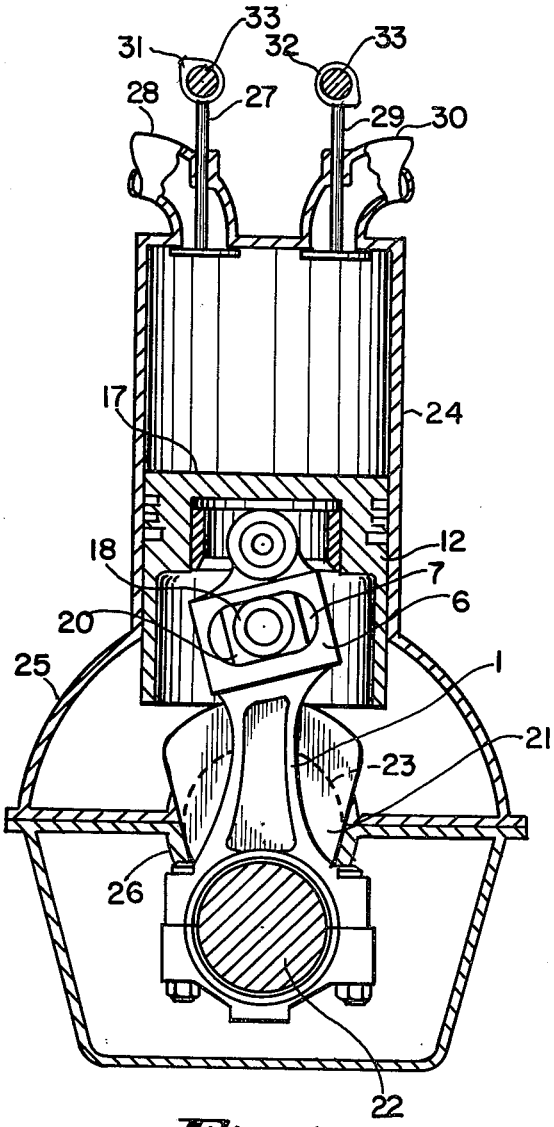
FIG. 10 is a frontal view of the reciprocating assembly showing the positional relationship of components when the crank is at the bottom-dead-center position of rotation.

At the end of the power stroke crankshaft 23 is at the bottom-dead-center position of rotation. This position is shown in FIG. 10. At this position the effective length of connecting rod 1 is the same as that shown in FIG. 8.

Figure 11:
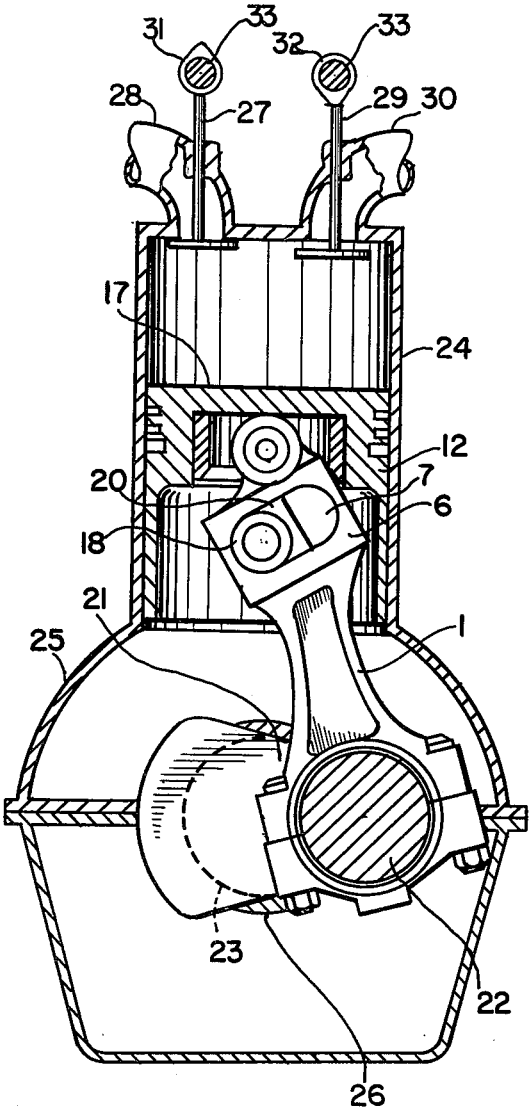
FIG. 11 is a frontal view showing the reciprocating components at the 270° position of crank rotation.

As crankshaft 23 continues its counter clockwise rotation piston 12 begins its upward thrust during the exhaust stroke. At the 270° crankarm 21 position and piston pin 18 is carried by carrier 20 to the left side of piston pin slot 7 as carrier 20 slides on carrier slide surfaces 8. This positional relationship is shown in FIG. 11. At this position the distance between the axial centers of piston pin 18 and crankpin 22 is less than when the crankshaft 23 was at the top or bottom dead-centers of crank rotation. The progressive shortening of the effective length of connecting rod 1 during this portion of engine cycle results in an initially slower upward thrust of piston 12 allowing a longer period for exhaust blowdown at pressures above critical flow conditions through exhaust valve 29. This reduces the mass of combustion gases which must be pushed from engine cylinder 24 by piston 12 and thus reduces the amount of pumping work required during the exhaust stroke. Slower piston speeds during this portion of the rotative cycle of the crank during the induction stroke improve the volumetric efficiency of the engine. The slower piston speeds also enhance mass transfer characteristics of the 2-cycle engine by increasing the period of side port communication with the swept volume of the engine cylinder.

When the slope of the angle of inclination of carrier slide surfaces 8, as shown in FIG. 3, are positive in terms mathematical convention, the effective angle of connecting rod 1 increases during the 1st. quadrant of crankshaft 23 counterclockwise rotation, decreases to the original length in the 2nd. quadrant of rotation, decreases to its shortest length in the third quadrant and increases to its original length in the 4th. quadrant of crank rotation. When the slope is negative the process is reversed with the effective length being shorter during the 1st. quadrant, longer during the 2nd. and 3rd. quadrant and shorter during the 4th. quadrant of crankshaft 23 rotation. One application of negative slope inclination would be in the operation of diesel engines on low cetane fuels where the compression rate should be more gradual and in jection pressure rise rate at the initial combustion must be slower in order to prevent detonation.

Figure 4:
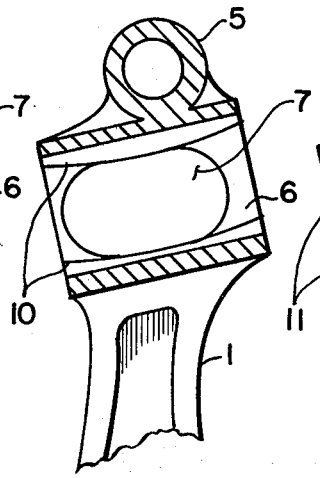
FIG. 4 is a cutaway view of the upper portion of the connecting rod showing an alternate method of constructing the carrier slides in the inclined slot housing.
Figure 5:
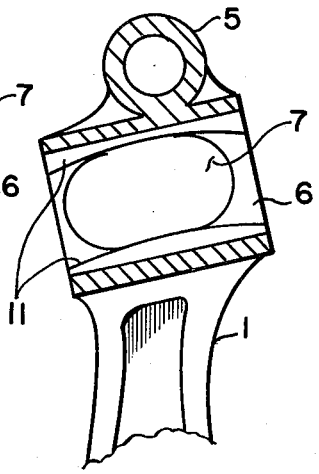
FIG. 5 is a cutaway view of the upper portion of the connecting rod showing a second alternate method of constructing the carrier slides in the inclined slot housing.

When curved parallel carrier slide surfaces 10 or 11 shown in FIGS. 4 and 5 respectively are used the direction of inclination has the same effect of increasing or decreasing the effective length of connecting rod 1 as previously discussed. The amount of curvature will however, moderate the rate of change of the effective length. In this respect the terminal velocity of the piston 12 at each end of its stroke will be modified in a manner which in some instances, as in the case of gasoline engine operation on low octane fuels, can be used to slow the terminal compression rate or to extend the initial period of high combustion pressures above the piston in other designs.

From the foregoing discussion and descriptive matter presented, it can be seen that the novelty of the invention is versatile and can be applied to the design of a variety of engines and engine applications.

What is claimed is:

1. A reciprocating assembly comprising a piston and a connecting rod, said piston comprising a crown, a skirt, two bosses positioned on opposite adjacent sides of said skirt, sliding surfaces on an interior of said crown parallel to the axis of the piston, a slide slidably mounting on said sliding surfaces, two bosses positioned on opposite adjacent sides of said slide, a connecting rod comprising a large journal at one end and a small journal at an opposite end, a connecting column between said large journal and said small journal, a carrier housing positioned below said small journal on said connecting column, said carrier housing comprising an interior portion having a plurality of carrier slide surfaces located perpendicular and parallel to the carrier housing longitudinal axis, said carrier slide surfaces being inclined to the longitudinal axis of said connecting column relative to a perpendicular projection of axial centers of said large and small journals, slots on each side of said carrier housing, a pin extending transversally through said small journal and pivotally journalled at each end in said bosses of said slide, a carrier slidably mounted on and moving parallelly along said carrier slide surfaces, a hole in the center of said carrier, a second pin journaled in said hole and extending transversally through said slots in said carrier housing and pivotally journaled in said bosses on said piston skirt.

2. The reciprocating assembly of claim 1 in which the said carrier slide surfaces have parallel straight surfaces inclined on a positive slope.

3. The reciprocating assembly of claim 1 in which the said carrier slide surfaces have parallel straight surfaces inclined in a negative slope.

* * * * *